US007421810B2

(12) United States Patent
Schymura

(10) Patent No.: US 7,421,810 B2
(45) Date of Patent: Sep. 9, 2008

(54) PICTURE FRAME ASSEMBLY FOR MOUNTING TO A CYLINDRICAL OBJECT

(76) Inventor: Margarete Schymura, 2350 Broadway, New York, NY (US) 10024

( * ) Notice: Subject to any disclaimer, the term of this patent is extended or adjusted under 35 U.S.C. 154(b) by 0 days.

(21) Appl. No.: 10/580,897

(22) PCT Filed: Dec. 17, 2004

(86) PCT No.: PCT/US2004/042503

§ 371 (c)(1),
(2), (4) Date: Sep. 11, 2006

(87) PCT Pub. No.: WO2005/062797

PCT Pub. Date: Jul. 14, 2005

(65) Prior Publication Data

US 2007/0119084 A1 May 31, 2007

Related U.S. Application Data

(60) Provisional application No. 60/531,336, filed on Dec. 19, 2003.

(51) Int. Cl.
*A47G 1/06* (2006.01)

(52) U.S. Cl. ..... 40/738; 248/218.1; 396/656; 40/471; 40/606.12; 40/611.1; 40/655; 40/743; 40/750; 40/757; 40/765; 40/768; 40/771; 40/781; 430/432; 52/506.05; 52/81.2

(58) Field of Classification Search ..... 40/745, 40/768, 743, 767, 769–779
See application file for complete search history.

(56) References Cited

U.S. PATENT DOCUMENTS

| | | | | |
|---|---|---|---|---|
| 1,580,496 | A * | 4/1926 | Kelly | 396/656 |
| 1,649,415 | A * | 11/1927 | Moseson | 40/765 |
| 1,752,297 | A | 4/1930 | Gillette | |
| 3,411,226 | A | 11/1968 | Ericsson | |
| 3,694,947 | A | 10/1972 | Mukai et al. | |
| 3,879,874 | A * | 4/1975 | Broussard, Sr. | 40/768 |
| 6,276,084 | B1 | 8/2001 | Lanier | |
| 6,293,038 | B1 | 9/2001 | Chang | |
| 6,439,520 | B1 * | 8/2002 | Johnson | 248/218.1 |
| 6,742,294 | B1 * | 6/2004 | Fossum | 40/611.1 |
| 2001/0005953 | A1 * | 7/2001 | Painsith | 40/750 |
| 2003/0196365 | A1 * | 10/2003 | Bracker et al. | 40/738 |

* cited by examiner

*Primary Examiner*—Lesley D. Morris
*Assistant Examiner*—Shin Kim
(74) *Attorney, Agent, or Firm*—Cohen Pontani Lieberman & Pavane LLP

(57) ABSTRACT

A picture frame assembly includes a backing plate having a front surface, a rear surface, and a plurality of parallel grooves in one of the surfaces. The material and thickness of the backing plate are chosen so that the backing plate may be plastically deformed about a bending axis parallel to the grooves. At least one frame element, which may be formed integrally with the backing plate, is for provided for retaining a planar picture element against the front surface of the backing plate. A pair of tack elements extending from the rear surface are provided for mounting the assembly to a cylindrical object such as a tree or a candle.

24 Claims, 5 Drawing Sheets

PICTURE FRAME ASSEMBLY FOR MOUNTING TO A CYLINDRICAL OBJECT

PRIORITY CLAIM

This is a U.S. national stage of application No. PCT/US04/042503, filed on Dec. 17, 2004. Priority is claimed on the following application(s): U.S. Provisional, Application No.: 60/531,336, Filed: Dec. 19, 2003; the content of which is incorporated here by reference.

BACKGROUND OF THE INVENTION

The invention relates to a picture frame assembly of the type including a backing plate and at least one frame element for retaining a planar picture element against the backing plate.

Picture frame assemblies including a backing plate and a frame element for retaining a photograph or other planar picture element against the backing element are well known. Such assemblies include means for retaining the backing element in the frame, and may include a sheet of glass or other transparent material over the picture element. Picture frames come in assorted shapes and sizes and are generally flat so that they may be hung flush with a flat surface.

Miniature picture frames are also well known, and are sometimes used as part of a memorabilia display and as elements of memorials. It is sometimes desired to fix the picture frame to a cylindrical object such as a tree, a column, or a candle, but a picture frame assembly which fits flush against a cylindrical object, in particular a picture frame assembly which may be readily adjusted to any desired radius of curvature, is not available.

SUMMARY OF THE INVENTION

It is an object of the invention to provide a picture frame assembly which has a curved backing plate, in particular a curved backing plate which may be plastically deformed to any desired radius of curvature.

It is another object of the invention, to provide a backing plate having a rear surface provided with tack elements, so that the backing plate may be readily mounted to a penetrable object such as a tree, a rose stem, or a candle. The tack elements may be stamped and formed from apertures in a metal backing plate, provided as discrete tacks fixed to the backing plate, or molded integrally with a plastic backing plate.

It is another object of the invention, to provide a deformable frame for a deformable backing plate, in particular a frame which is formed in one piece with the backing plate.

It is another object of the invention, to provide a picture frame assembly which is sufficiently low in cost that it may be placed at an outdoor memorial without inviting theft.

According to the invention, a picture frame assembly includes a backing plate having a front surface, a rear surface, and a plurality of parallel grooves in one of the surfaces. The material and thickness of the backing plate are chosen so that the backing plate may be plastically deformed about a bending axis parallel to the grooves, while the ribs between the grooves are sufficiently stiff to resist bending about other axes.

The backing plate is also provided with tack elements which may be stamped and formed from apertures in the backing plate to extend normally of the rear surface. Alternatively the tack elements may be discrete tacks which are fixed to the rear surface.

According to a preferred embodiment, frame elements are formed integrally with the backing plate by bending along grooves parallel to lateral edges.

According to another embodiment, a transparent curved frame plate has lateral edges formed with clips which receive the lateral edges of the backing plate.

According to another embodiment, a frame plate having an aperture is formed as one piece with the backing plate and connected to the backing plate by a fold so that a planar picture element and a protective transparent sheet can be sandwiched between the front surface of the backing plate and the rear surface of the frame plate. The frame plate preferably has retaining tabs which can be folded against the rear surface of the backing plate to retain the picture element.

According to an embodiment designed for an object having a known diameter, such as a candle, a frame element is provided with a curved frame plate having an aperture and a surrounding wall having an edge with a radius of curvature which is smaller than that of the frame plate. The edge is provided with retaining tabs which are deformed to bear against the rear surface of the backing plate, which is received within the surrounding wall. The plastic deformability of the backing plate assures that a picture element will be held flush against the rear surface of the frame plate, together with an optional transparent sheet, giving a neat appearance.

Since the picture frame assembly according to the invention may be economically manufactured by molding plastic and/or stamping and forming sheet metal, it may be left at an outdoor memorial without significant risk of theft.

DETAILED DESCRIPTION OF THE PRESENTLY PREFERRED EMBODIMENTS

Figure 1A:
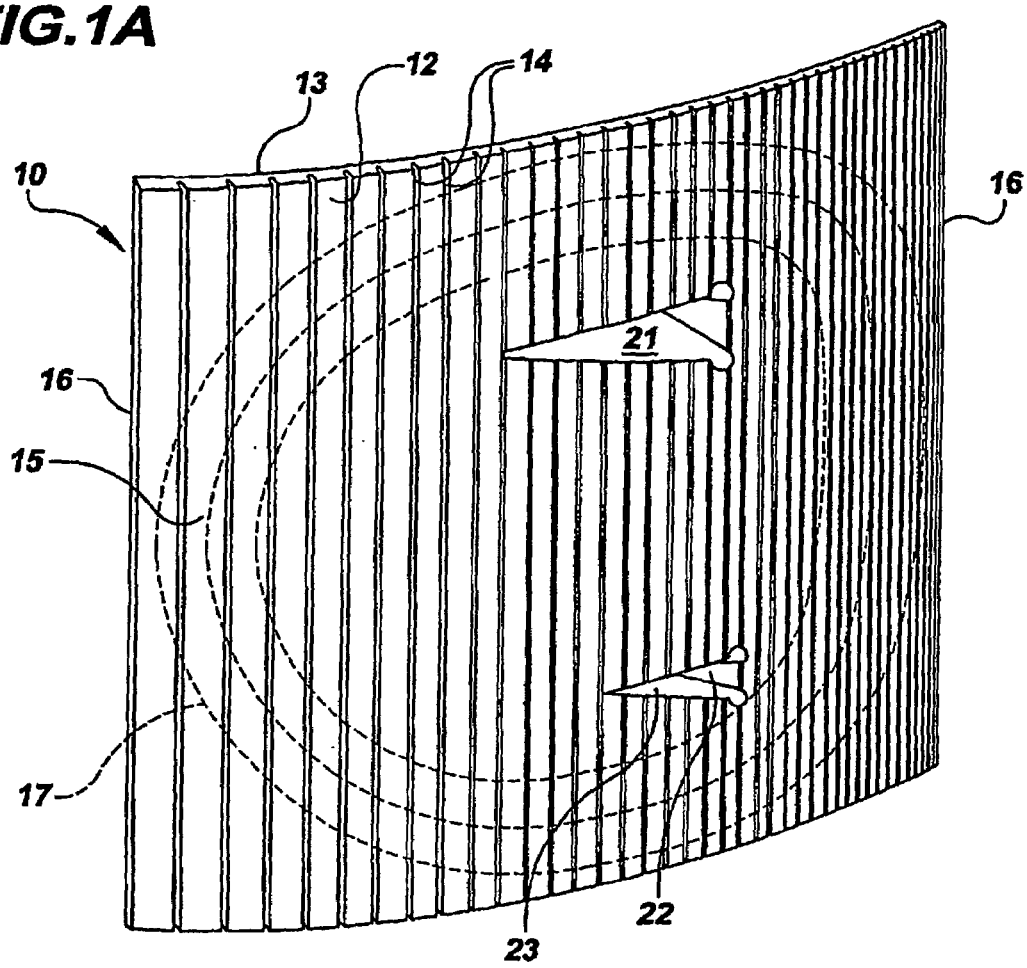
FIG. 1A is a perspective of a backing plate according to the invention.
Figure 1B:
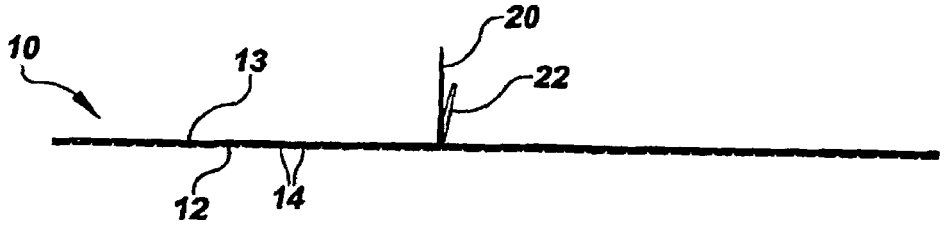
FIG. 1B is a top view of the backing plate prior to bending.
Figure 1C:
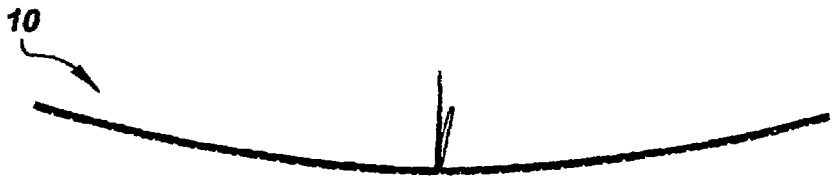
FIG. 1C is a top view of the backing plate after bending.

FIGS. 1A to 1C show a backing plate 10 having a front surface 12, a rear surface 13, a plurality of parallel grooves 14 in the front surface 12, and a pair of lateral edges 16 parallel to the grooves 14. A pair of tack elements 20, 22 are stamped from respective apertures 21, 23 and formed to extend normally of the rear surface 13. Both tack elements 20, 22 are preferably formed along a common bending axis parallel to the grooves. The material chosen for the backing plate 10, as well as its thickness and the depth of the grooves 14, are chosen to facilitate plastic deformation from the flat configuration of FIG. 1B to the curved configuration of FIG. 1C. At the same time, the ribs 15 between the grooves 14 are sufficiently stiff to resist bending about axes which are not parallel to the grooves. The material is preferably metal such as sheet aluminum, but may also be plastic. The grooves 14 may be formed by stamping (metal material) and are not present in the tack elements 20, 22, which must be relatively stiff to penetrate a tree trunk. The tack elements are preferably of different lengths, the longer element 20 assuring good retention, the shorter element 22 serving primarily as an orientation feature. While the grooves are shown in the front surface 12, they may alternatively be provided in the rear surface 13.

The elliptic lines 17 shown in phantom in FIG. 1A serve as a guide for cutting the backing plate 10 to any desired shape, in particular symmetric shapes such as an ellipse.

Figure 2A:
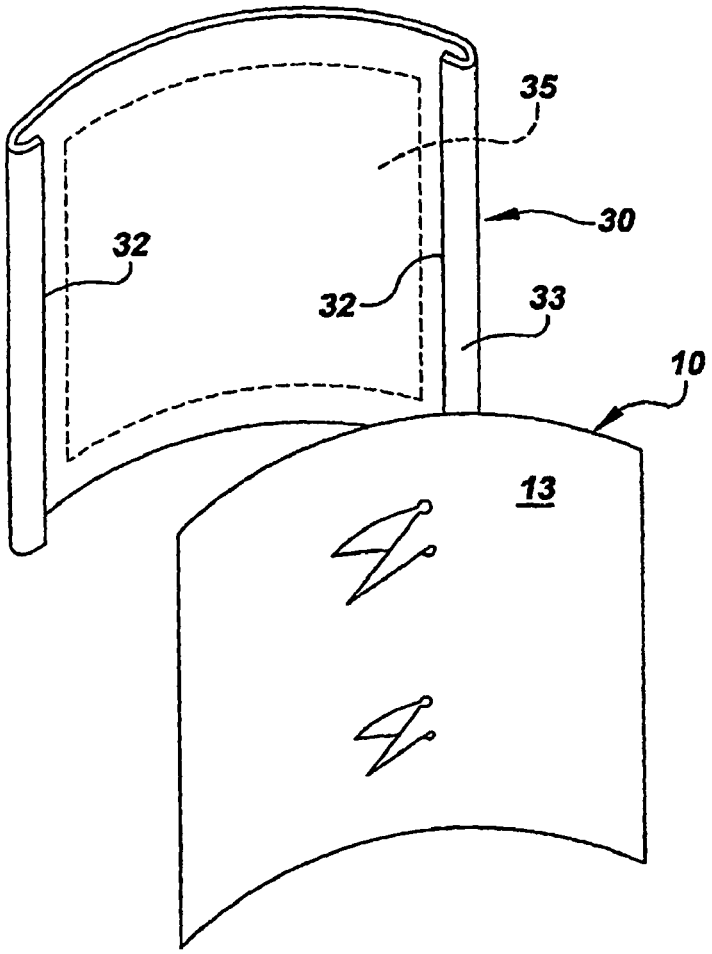
FIG. 2A is an exploded perspective of a first embodiment of picture frame assembly according to the invention.
Figure 2B:
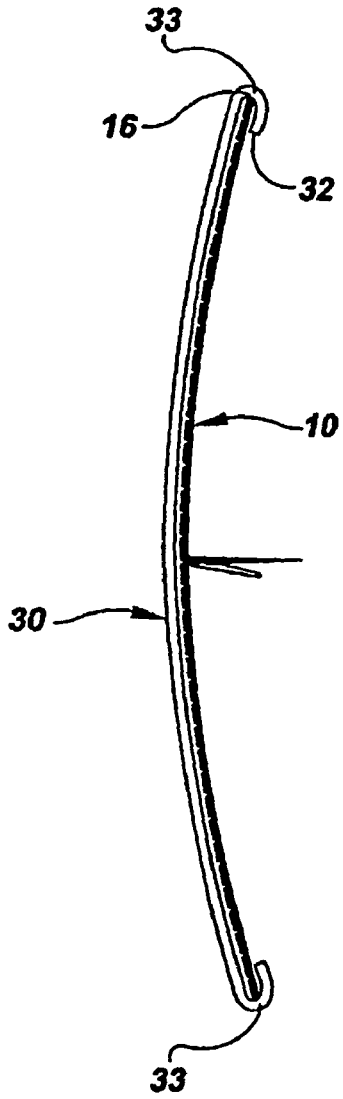
FIG. 2B is a top view of the backing plate and cover of the first embodiment.

FIGS. 2A and 2B show the backing plate 10 of FIG. 1A, and a transparent frame plate 30 having a pair of lateral edges 32 formed with U-shaped clips 33 for receiving the lateral edges 16 of the backing plate 10. A planar picture element such as a photograph may be received substantially flushly against the backing plate 10 between the backing plate 10 and the frame plate 30, which is preferably plastic such PMMA and also serves as a protective cover for the photograph. Alternatively, the frame plate 30 may be made of metal and provided with an aperture 35, shown in phantom, as well parallel grooves (not shown) to facilitate bending.

Figure 3C:
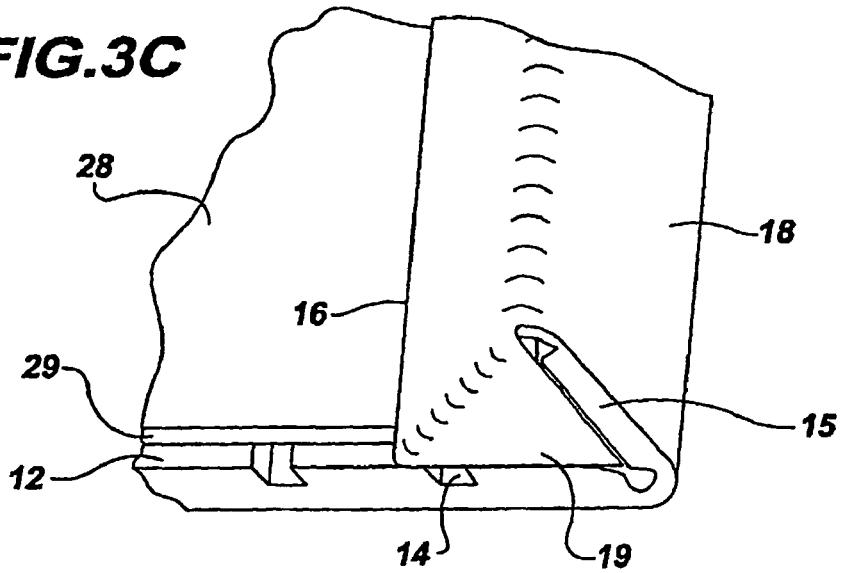
FIG. 3C is a perspective of the retaining tab formed integrally with the frame element of the second embodiment.
Figure 3A:
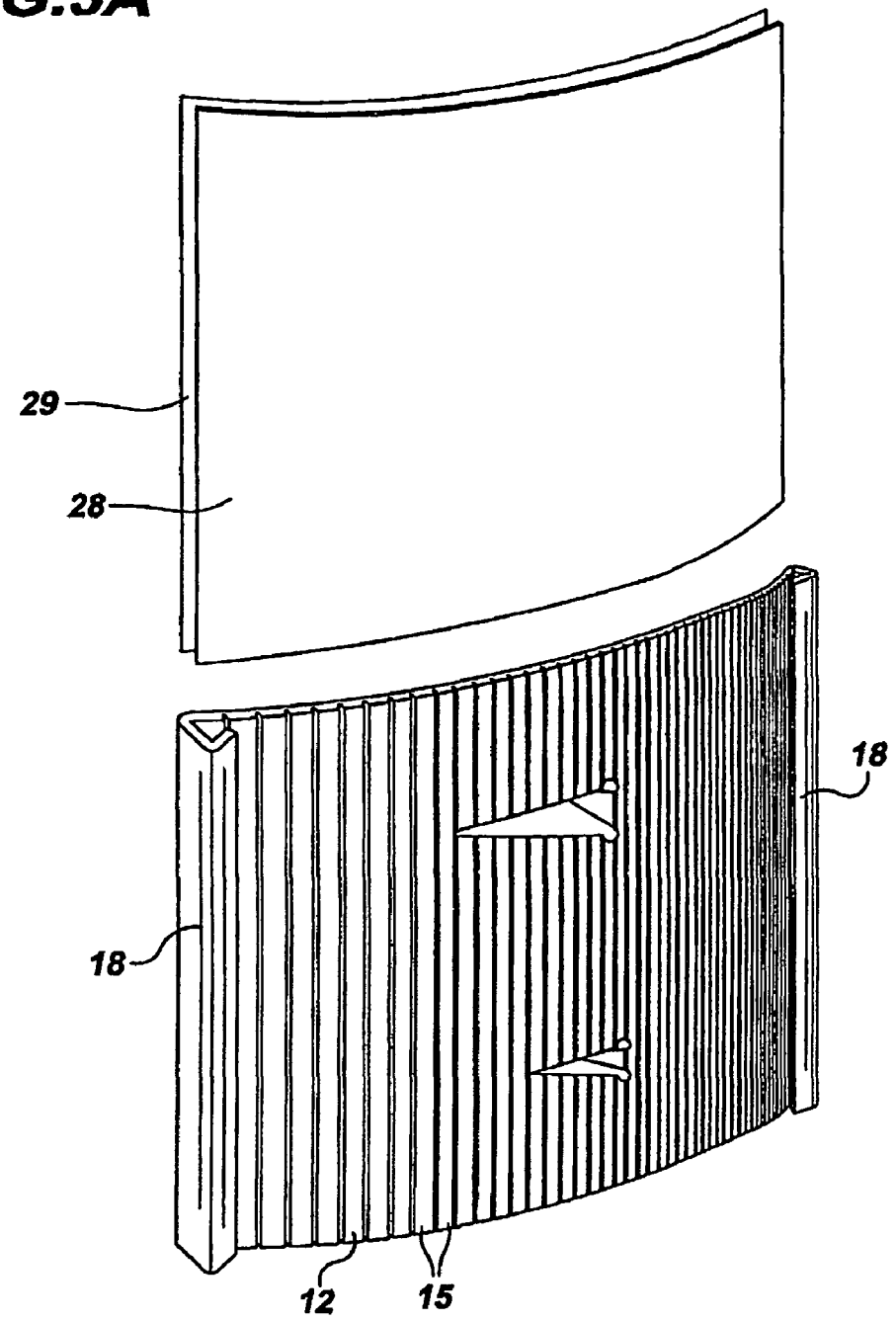
FIG. 3A is an exploded perspective of a second embodiment of picture frame assembly according to the invention.
Figure 3B:
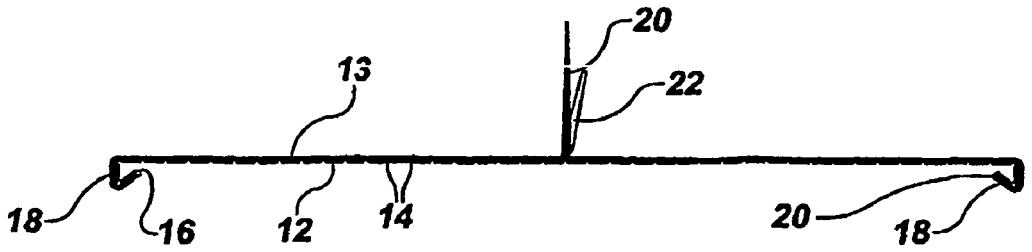
FIG. 3B is a top view of the backing plate of the second embodiment prior to bending.

FIG. 3A shows a backing plate 10 which is similar to that of FIG. 1 A, with the lateral edges 16 each folded forward along the two grooves 14 adjacent to the edge to form lateral frame elements 18 for retaining a photograph 29 and a transparent sheet 28 against the front surface 12. As shown in FIG. 3B, the frame elements 18 are preferably formed prior to bending the plate 10 to its curved configuration. As shown in FIG. 3C, each frame element 18 has at least one end formed with a retaining tab 19 which serves as a stop to prevent a picture element 29 from sliding parallel to the grooves 14. The triangular shape of the tab 19 prevents frame element 18 from being folded too far, which could overstress the thin material in the bottom of the second groove 14. The transparent sheet 28 is preferably acetate or like material which does not have sufficient elasticity to reverse the plastic deformation of the backing plate 10.

Figure 4A:
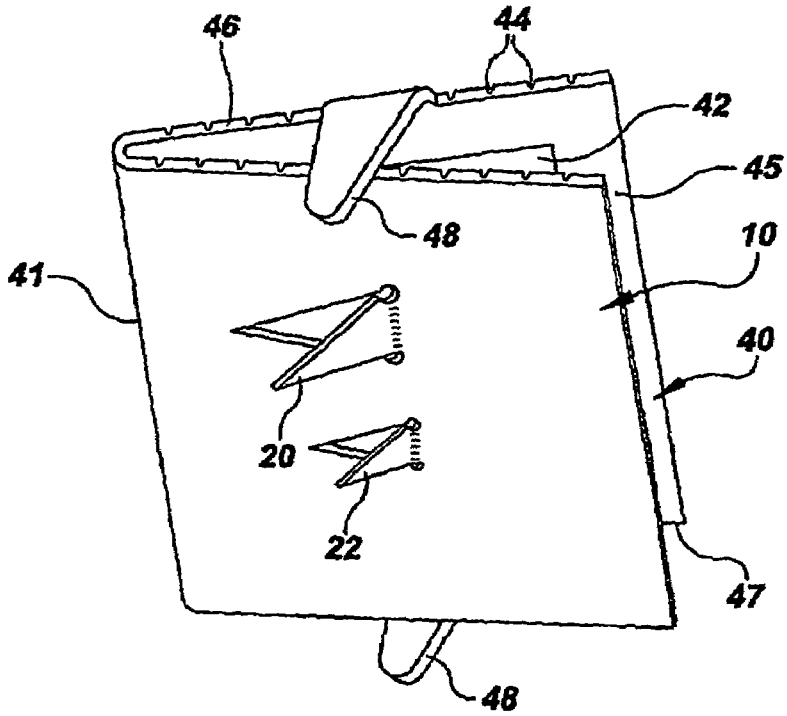
FIG. 4A is a perspective of a third embodiment wherein a frame plate is integrally formed with the backing plate.
Figure 4B:
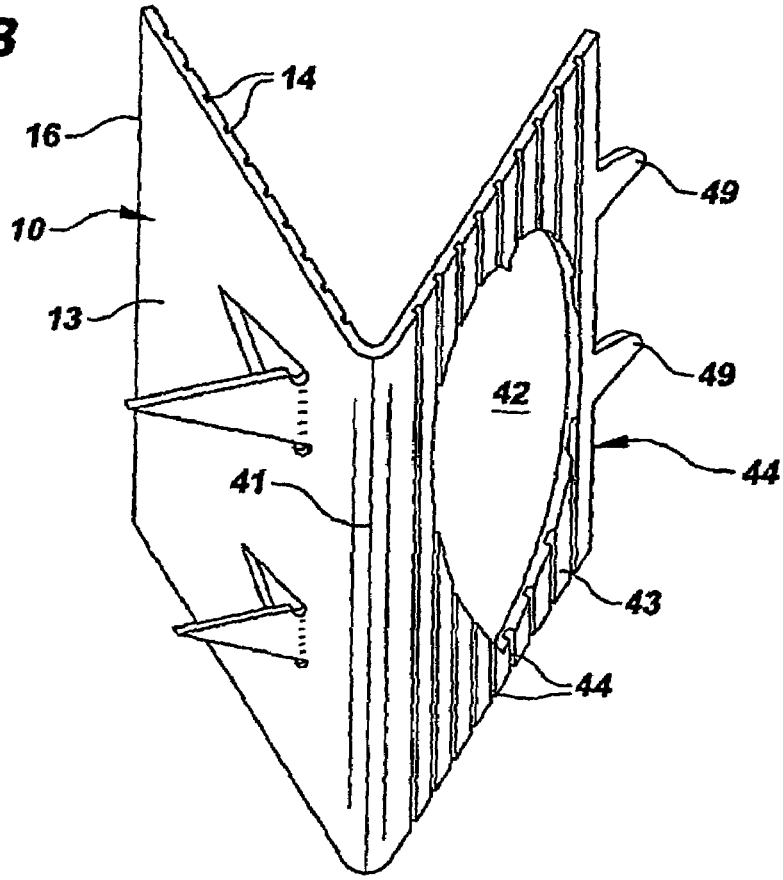
FIG. 4B is a perspective of a modified form of the third embodiment.

FIG. 4A shows a picture frame assembly wherein the frame plate 40 is formed integrally with the backing plate 10 and connected thereto by a fold 41. The frame plate 40 has an aperture 42, a front surface provided with grooves 43, and an opposed rear surface 44 which faces the front surface 12 of the backing plate 10. The top edge 46 and the bottom edge 48 are provided with retaining tabs 48 which are bent against the rear surface 13 of the backing plate 10 to secure a picture element such as a photograph between the plates 10, 40. Optionally, a transparent sheet such as sheet 28 in FIG. 3A may be also provided. FIG. 4B shows an alternative configuration wherein lateral retaining tabs 49 are provided; these tabs may also be provided in addition to the tabs 48. An alternative shape of aperture 42 is also shown.

Figure 5A:
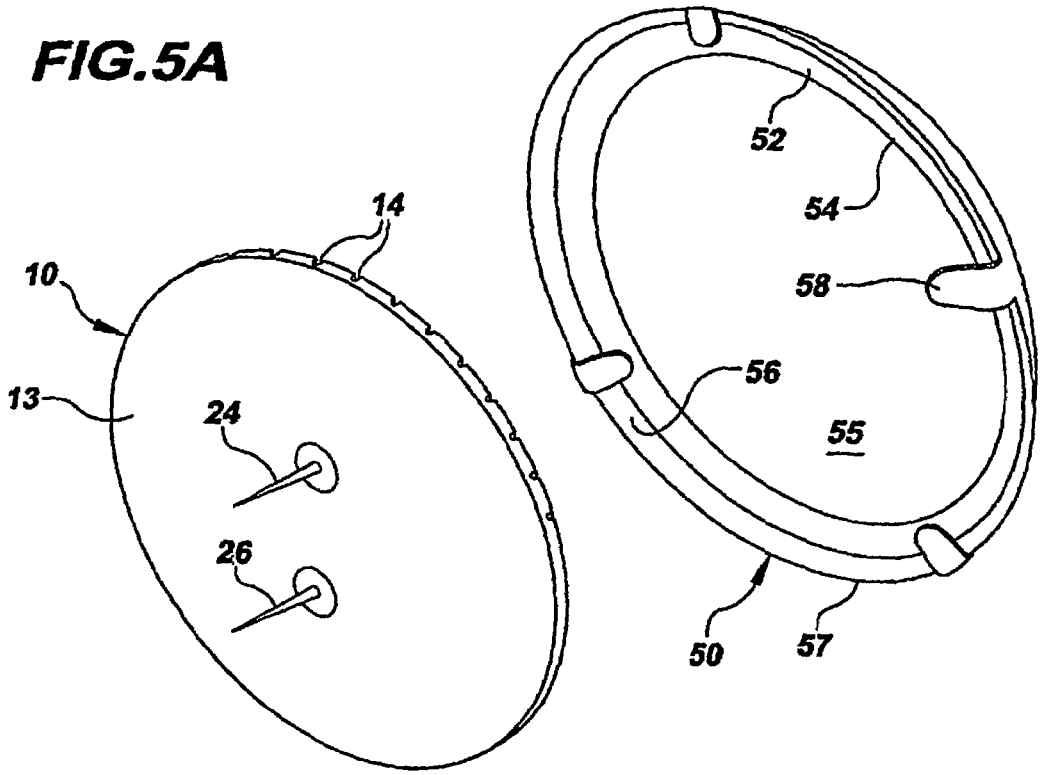
FIG. 5A is an exploded perspective of a fourth embodiment having a curved frame plate and surrounding wall.
Figure 5B:
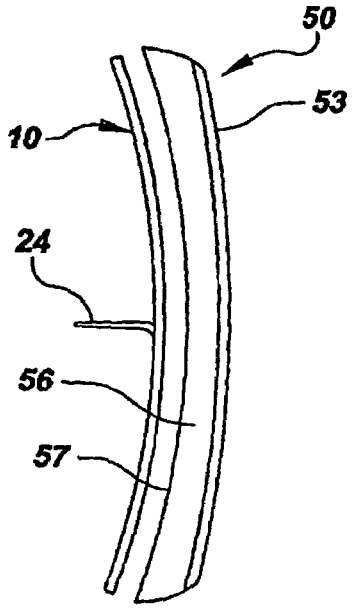
FIG. 5B is a top view of the fourth embodiment.

FIGS. 5A and 5B show a frame element 50 including a curved frame plate 52 having a front surface 53 and a rear surface 54 which receives a planar picture element visible through aperture 55, possibly with a protective transparent sheet. A surrounding wall 56 extends rearward from the periphery of the frame plate 52 to an edge 57 lying in a cylindrical plane having a radius of curvature which is smaller than that of the frame plate 52. The backing plate 10 is received within the surrounding wall 56 and held against a picture element by plastically deformable retaining tabs 58 extending from the edge 57. The backing plate 10 is shown with alternative tack elements in the form of discrete tacks 24, 26 which are soldered or brazed to the rear surface 13 of the backing plate. While not as economic to manufacture as the stamped tack elements 20, 22 shown in other figures, the tacks 24, 26 are available as a staple and are more sturdy. As best shown in FIG. 5B, the surrounding wall has its lowest height along a line formed by the two tacks 24, 26. Since the frame element is not intended to be deformed by a user, the radius of curvature of the rear edge 57 is preferably chosen to correspond to the diameter of a particular object to be decorated, in particular a candle. This makes it possible to create a stylish memorial utilizing a photograph of a loved one.

Figure 5C:
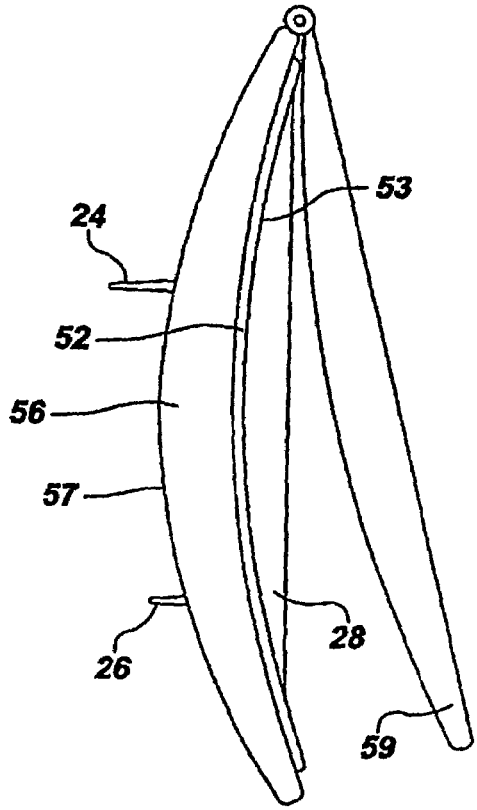
FIG. 5C is a side view showing a cover hinged to the frame element.

FIG. 5C shows a modification of the picture frame assembly of FIG. 5A and 5B, wherein a cover 59 is hinged to the frame element 50 to form a locket. A gasket may also be provided to protect the aperture from exposure to the elements. Gaskets or adhesive seals may also be provided in any embodiment wherever it is desired to prevent influx of moisture.

The foregoing is exemplary and not intended to limit the scope of the claims which follow.

The invention claimed is:

1. A picture frame assembly for mounting to a cylindrical surface, the assembly comprising:

a backing plate having a front surface, a rear surface, a plurality of parallel grooves formed in one of the surfaces, and a plurality of ribs alternating with said grooves, the backing plate being made of a material and having a thickness, the thickness at the grooves being less than the thickness at the ribs, the material and the thickness being chosen so that the backing plate may be plastically deformed about a bending axis parallel to the grooves;

a pair of tack elements extending from the rear surface of the backing plate, the tack elements extending from a line which is substantially parallel to the grooves; and at least one frame element for retaining a planar picture element against the front surface of the backing plate.

2. The picture frame assembly of claim 1 wherein the grooves are in the front surface.

3. The picture frame assembly of claim 1 wherein the backing plate has lateral edges parallel to the grooves, the backing plate being bent along a pair of grooves adjacent to each said lateral edge to form a pair of frame elements, wherein each said lateral edge faces the front surface to retain the planar picture element between the lateral edge and the front surface.

4. The picture frame assembly of claim 3 wherein each said frame element has at least one end formed with a retaining tab to prevent the planar picture element from sliding parallel to the grooves.

5. The picture frame assembly as in claim 4 wherein the tab is triangular in shape.

6. The picture frame assembly of claim 3 wherein the tack elements are formed along a common bending axis to extend from the rear surface.

7. The picture frame assembly of claim 1 wherein tack elements are stamped from and formed from apertures in the backing plate.

8. The picture frame assembly of claim 1 wherein the tack elements are formed separately and attached to the rear surface of the backing plate.

9. The picture frame assembly of claim 8 wherein the backing plate and the tacks are made of metal, the tack elements being attached to the backing plate by one of soldering, brazing, and welding.

10. The picture frame assembly of claim 1 wherein the tack elements have different lengths.

11. The picture frame assembly of claim 1 wherein the frame element comprises a frame plate which is formed as one piece with the backing plate and joins the backing plate at a fold which is parallel to the grooves, the frame plate having a front surface, a rear surface, and a plurality of parallel grooves in one of the surfaces, the back surface of the frame plate facing the front surface of backing plate to sandwich a planar picture element therebetween, the frame plate having an aperture for viewing the picture element.

12. The picture frame assembly of claim 11 wherein the frame plate has a top edge and a bottom edge extending transversely of the grooves, the frame plate having at least one pair of retaining tabs extending from the edges, the retaining tabs being foldable against the rear surface of the backing plate to retain the picture element between the frame plate and the backing plate.

13. The picture frame assembly of claim 1 wherein the backing plate has lateral edges parallel to the grooves, the frame element comprising a curved transparent frame plate which is received against the front surface of the backing plate, the transparent frame plate having lateral edges which are folded to form clips which receive the lateral edges of the backing plate, the transparent frame plate being curved.

14. The picture frame assembly of claim 13 wherein said frame plate is transparent.

15. The picture frame assembly of claim 13 wherein the frame plate has an aperture.

16. The picture frame assembly of claim 1 wherein the frame element comprises:

a curved frame plate having a first radius of curvature, the frame plate having a front surface, a rear surface, and an aperture for exposing a picture element received against the rear surface; and a surrounding wall upstanding from the rear surface of the frame plate for positioning the picture element and the backing plate, the surrounding wall having an edge remote from the rear surface of frame plate, the edge having at least one pair of retaining tabs which can be folded against the rear surface of the backing plate.

17. The picture frame assembly of claim 16 wherein the rear edge lies in a cylindrical plane having a second radius of curvature which is smaller than the first radius of curvature.

18. The picture frame assembly of claim 16 wherein the frame plate has an elliptical shape.

19. The picture frame assembly of claim 16 further comprising a cover which is hinged to the frame plate to form a locket.

20. A method of decorating a cylindrical surface, the method comprising:

providing a backing plate having a front surface, a rear surface, a plurality of parallel grooves formed in one of the surfaces, and a plurality of ribs alternating with said grooves, the backing plate being made of a material and having a thickness, the thickness at the grooves being less than the thickness at the ribs, the material and the thickness being chosen so that the backing plate may be plastically deformed about a bending axis parallel to the grooves, the backing plate having a pair of pointed tack elements extending from the rear surface, the tack elements being on a line which is parallel to the grooves;

providing at least one frame element for retaining a planar picture element against the front surface of the backing plate after the backing plate has been bent to a desired curved shape;

deforming the backing plate to assume a desired radius of curvature about the bending axis;

assembling the backing plate, the at least one frame element, and a planar picture element together to form a picture frame assembly; and pressing the tack elements into a cylindrical object.

21. The method of claim 20 wherein the backing plate is deformed to have a radius of curvature which is substantially the same as the radius of curvature of the cylindrical object.

22. The method of claim 20 wherein the frame element is formed separately from the backing plate, the method further comprising cutting the backing plate to fit the frame element.

23. The method of claim 20 wherein the picture element is received substantially flushly against the backing plate.

24. The apparatus of claim 1 wherein the frame element retains the planar picture element substantially flushly against the front surface of the backing plate.

* * * * *